US010648230B2

(12) United States Patent
Holt et al.

(10) Patent No.: US 10,648,230 B2
(45) Date of Patent: May 12, 2020

(54) ATTACHMENT MEMBER FOR AN ARCHITECTURAL COVERING

(71) Applicant: Hunter Douglas, Inc., Pearl River, NY (US)

(72) Inventors: Ronald Holt, Westminster, CO (US); Stephen T. Wisecup, Longmont, CO (US); Arnold DeCarlo, Frederick, CO (US)

(73) Assignee: HUNTER DOUGLAS, INC., Pearl River, NY (US)

( * ) Notice: Subject to any disclaimer, the term of this patent is extended or adjusted under 35 U.S.C. 154(b) by 102 days.

(21) Appl. No.: 15/718,384

(22) Filed: Sep. 28, 2017

(65) Prior Publication Data

US 2018/0106101 A1 Apr. 19, 2018

Related U.S. Application Data

(60) Provisional application No. 62/408,571, filed on Oct. 14, 2016.

(51) Int. Cl.
*E06B 9/42* (2006.01)
*E06B 9/262* (2006.01)
*E06B 9/38* (2006.01)

(52) U.S. Cl.
CPC ..... *E06B 9/42* (2013.01); *E06B 9/262* (2013.01); *E06B 9/38* (2013.01); *E06B 2009/2622* (2013.01)

(58) Field of Classification Search
CPC ..... E06B 9/262; E06B 2009/2625; E06B 2009/2627; E06B 2009/2622; E06B 9/17046
See application file for complete search history.

(56) References Cited

U.S. PATENT DOCUMENTS 4,877,075 A * 10/1989 Markowitz ..... E06B 9/262 160/84.01
5,176,192 A * 1/1993 Judkins ..... E06B 9/262 160/84.04
5,320,154 A * 6/1994 Colson ..... E06B 9/171 160/121.1
5,647,421 A 7/1997 Hoffmann et al.
(Continued)

FOREIGN PATENT DOCUMENTS

WO 2012142519 A1 10/2012
WO 2014000078 A1 1/2014

OTHER PUBLICATIONS

Search Report from GB1716860.0 dated Mar. 27, 2018, 3 pages.

*Primary Examiner* — Katherine W Mitchell
*Assistant Examiner* — Abe Massad

(57) ABSTRACT

An attachment member for coupling a shade material of an architectural covering to a rail member. The attachment member may include a first portion arranged to perform a first function affecting the shade material in a first manner, and a second portion arranged to perform a second function affecting the shade material in a second manner. The first portion may be arranged to couple the shade material to the rail member, such as coupling the shade material within the rail member. The second portion may be arranged to affect a portion of the shade material with respect to the rail member, such as affecting a portion of the shade material external to the rail member.

14 Claims, 4 Drawing Sheets

(56) References Cited

U.S. PATENT DOCUMENTS

| | | | | |
|---|---|---|---|---|
| 5,649,583 | A * | 7/1997 | Hsu | E06B 9/262 160/84.05 |
| 5,746,266 | A * | 5/1998 | Colson | B29C 53/36 156/197 |
| 6,328,090 | B1 * | 12/2001 | Anderson | E06B 7/30 160/107 |
| 6,876,493 | B1 | 4/2005 | Lin | |
| 6,978,821 | B2 | 12/2005 | Welfonder | |
| 7,458,175 | B2 | 12/2008 | Meyer et al. | |
| 7,510,111 | B2 | 3/2009 | Mikkelsen et al. | |
| 8,291,962 | B2 | 10/2012 | Allsopp et al. | |
| 8,496,768 | B2 * | 7/2013 | Holt | E06B 9/34 156/65 |
| 9,004,142 | B2 | 4/2015 | Marocco | |
| 9,062,493 | B2 | 6/2015 | Marocco | |
| 9,328,552 | B2 * | 5/2016 | Dann | E06B 9/24 |
| 9,840,867 | B2 | 12/2017 | Lukosiunas et al. | |
| 2003/0094247 | A1 | 5/2003 | Voss et al. | |
| 2006/0048904 | A1 * | 3/2006 | Gruner | E06B 9/262 160/84.05 |
| 2006/0201350 | A1 | 9/2006 | Veivers et al. | |
| 2006/0219373 | A1 | 10/2006 | McKinney | |
| 2006/0219374 | A1 | 10/2006 | McKinney | |
| 2006/0225846 | A1 | 10/2006 | Marusak et al. | |
| 2007/0069559 | A1 | 3/2007 | Poulakis | |
| 2008/0035281 | A1 | 2/2008 | Kirby | |
| 2011/0049071 | A1 | 3/2011 | Hart et al. | |
| 2012/0291964 | A1 | 11/2012 | Marocco | |
| 2012/0291965 | A1 | 11/2012 | Marocco | |
| 2015/0075726 | A1 * | 3/2015 | Byun | E06B 9/262 160/84.04 |
| 2016/0160492 | A1 | 6/2016 | Gower | |

* cited by examiner

ATTACHMENT MEMBER FOR AN ARCHITECTURAL COVERING

CROSS-REFERENCE TO RELATED APPLICATIONS

This application claims priority to U.S. Provisional Patent Application Ser. No. 62/408,571, filed Oct. 14, 2016, titled "Attachment Member for an Architectural Covering", the entirety of which application is incorporated by reference herein.

FIELD OF THE DISCLOSURE

The present disclosure relates generally to architectural coverings, and more specifically to an attachment member for an architectural covering.

BACKGROUND OF THE DISCLOSURE

Architectural coverings, such as coverings for structures, including walls, and openings, such as windows, doorways, archways, and the like, have taken numerous forms for many years. Some coverings include a shade material or element (referenced herein as "shade material" for the sake of simplicity and without intent to limit) coupled to a rail member (e.g., a bottom rail or other element engaged by the user to move the shade or provided to finish an end of the shade or to weight the shade) via an attachment member, which may be a strip of material frictionally engaging a portion of the shade material to the rail member. For instance, the attachment member (which may be called a "fabric lock" or "shade lock" in some instances) may be coupled to the shade material to create an enlarged area which may then be inserted into a groove or slot of the rail member and locked therein to couple the shade material to the rail member. The weight of the rail member typically is transferred to the shade material via the attachment member. Depending on the type of shade material, the weight of the rail member may cause a bottom portion of the shade material to be positioned, such as shaped, differently from portions of the shade material distal from the rail member, which may reduce the aesthetic and/or functional characteristics of the covering. Additionally, or alternatively, if the attachment member is used to couple the shade material by insertion of the shade material and attachment member into a groove or slot in the rail member, then the shade material may be constricted or angled or otherwise affected by the insertion into the rail member, thereby affecting the appearance of the shade material in a manner which may be undesirable.

SUMMARY OF THE DISCLOSURE

The present disclosure generally provides an attachment member for an architectural covering that offers improvements or an alternative to existing arrangements. The attachment member is arranged to provide two or more functions to affect a shade material in two or more manners. In one disclosed embodiment, the attachment member is arranged both to couple the shade material to a rail member and to position a portion of the shade material, such as an external portion of the shade material, relative to the rail member to affect the configuration, including without limitation the appearance, shape, distance, and/or position, of the shade material, such as causing a more uniform profile appearance of one or more cells of a cellular shade material. The attachment member is arranged to couple the shade material to the interior of the rail member while simultaneously positioning or shaping a portion of the shade material located external to the rail member.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The accompanying drawings, which are incorporated into and constitute a part of the specification, illustrate embodiments of the present disclosure by way of illustration only and, together with the general description above and the detailed description below, serve to explain the principles of the present disclosure.

DETAILED DESCRIPTION

Figure 1:
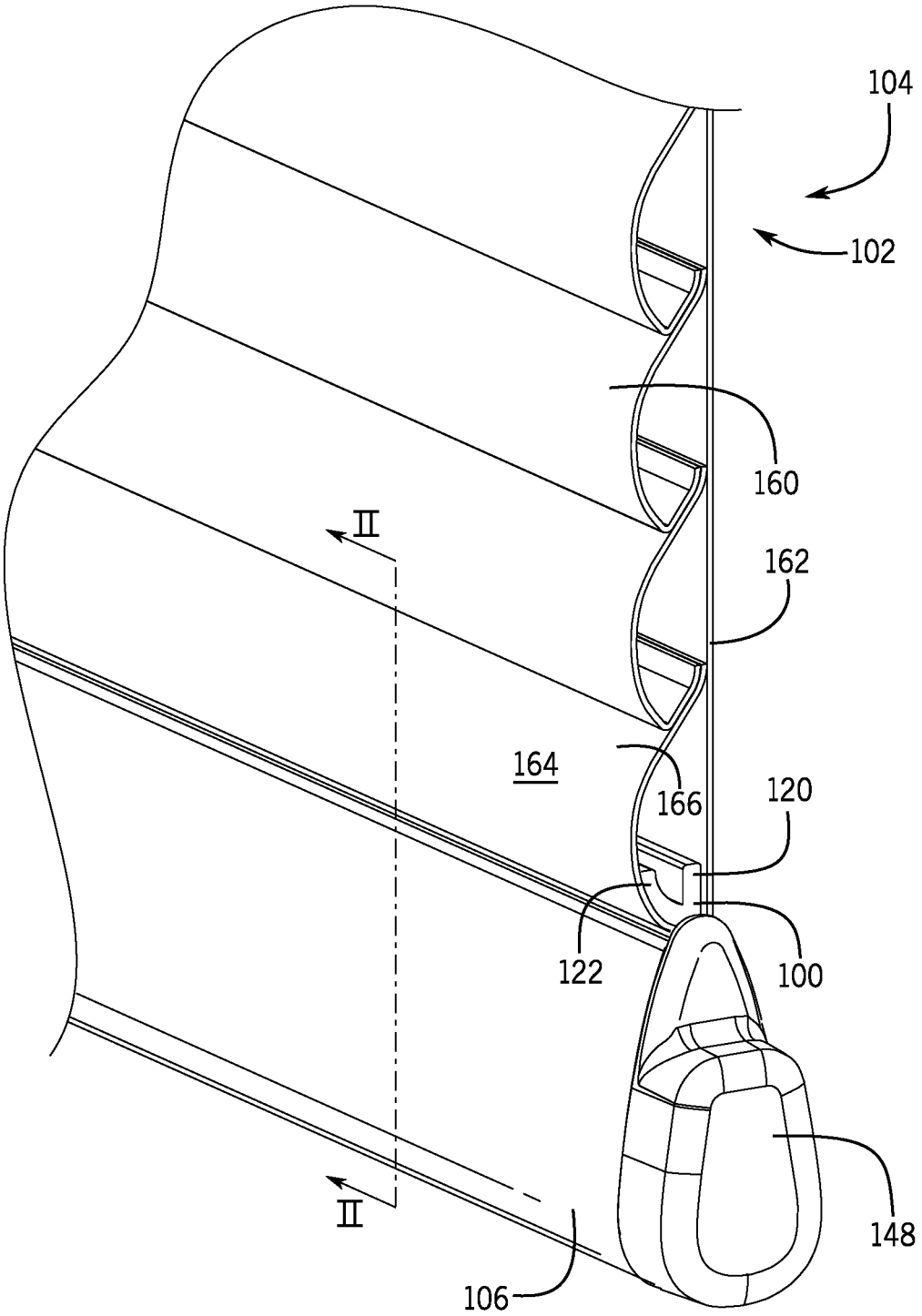
FIG. 1 is a fragmentary isometric view of an architectural covering in accordance with an embodiment of the present disclosure.
Figure 2:
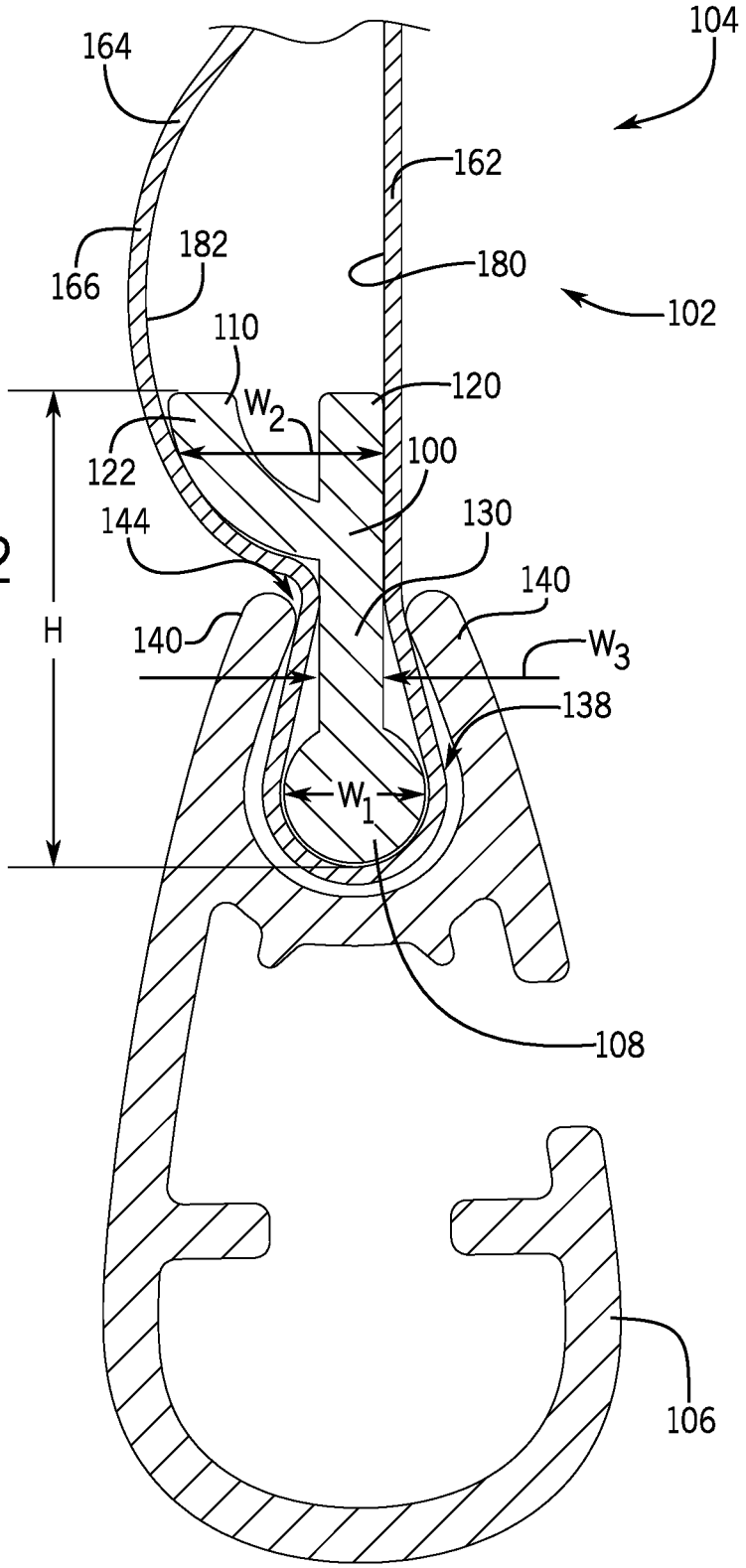
FIG. 2 is a fragmentary cross-sectional view taken along line II-II of FIG. 1 in accordance with an embodiment of the present disclosure.
Figure 3:
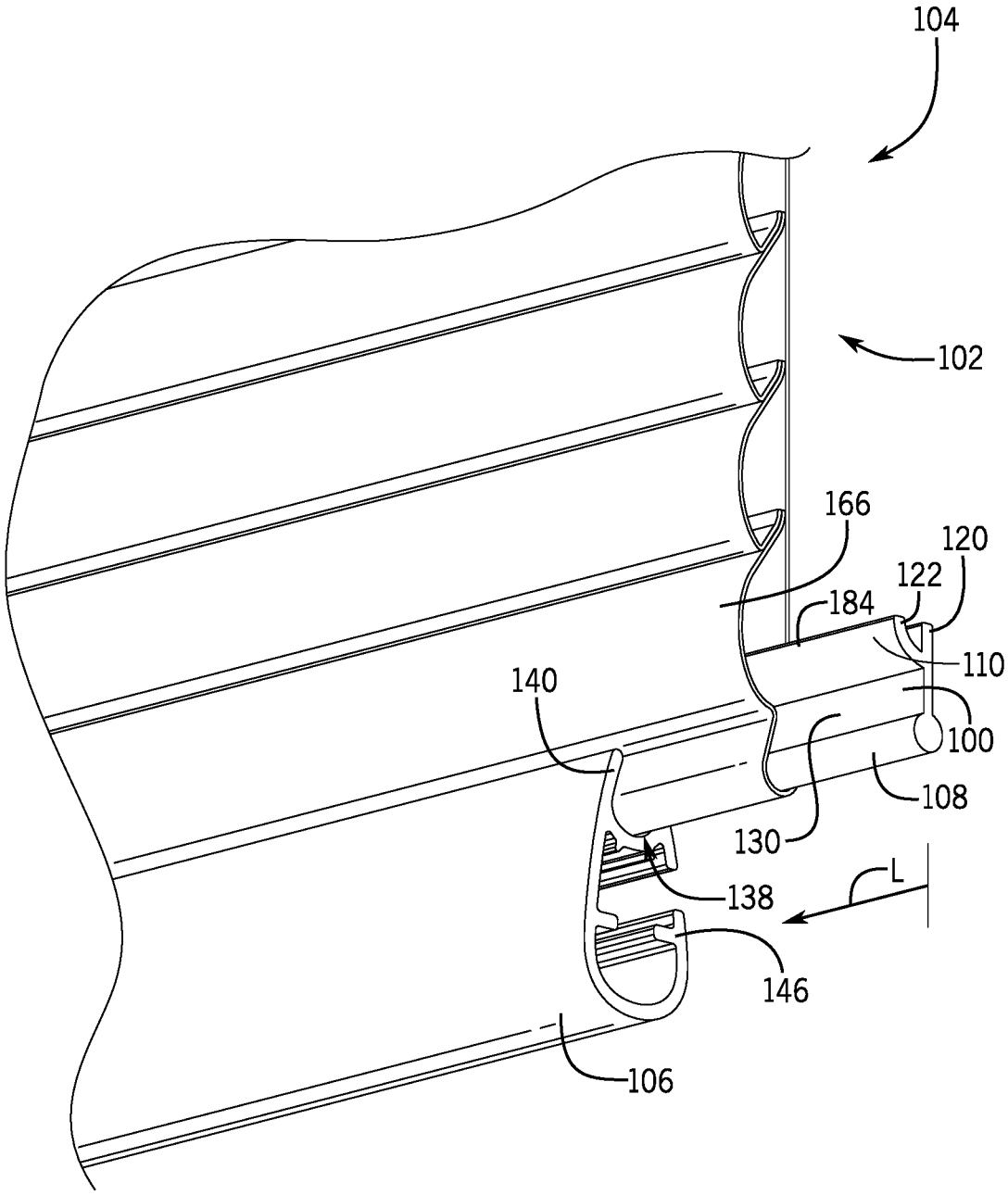
FIG. 3 is a partially exploded view of the covering of FIG. 1 showing elements of the covering not in a final assembled configuration in accordance with an embodiment of the present disclosure.

In accordance with various embodiments of the present disclosure, an attachment member 100 is provided for coupling a shade material 102 of an architectural covering 104 to a rail member 106 (see FIGS. 1-3). As explained more fully below, the attachment member 100 is arranged to couple the shade material 102 to the rail member 106 and to affect a portion of the shade material 102, such as a lowermost portion of the shade material 102, external to the rail member 106. In one embodiment, illustrated in FIGS. 1-3, the attachment member 100 includes opposing first and second portions 108, 110 arranged to perform separate functions. For example, the first portion 108, which may be considered a securement, connection, and/or rail engagement portion, element, or section or any combination thereof, may be sized and shaped to affect the shade material 102 in a first manner, such as coupling the shade material 102 to the rail member 106. The second portion 110, which may be considered a shade positioning, a shade affecting, and/or a shade shaping portion, element, or section or any combination thereof, may be sized and shaped to affect the shade material 102 in a second manner, such as positioning a portion of the shade material 102 relative to the rail member 106 such as to achieve a desired aesthetic and/or functional characteristic external to the rail member 106, as explained in more detail below. In at least one embodiment, the second portion 110 and/or the portion of the shade material 102 affected by the second portion 110 are positioned external to the rail member 106 (in contrast with the first portion 108 which is within the rail member 106 and locks a portion of the shade material 102 within the rail member 106, as described in further detail below). In at least one embodiment, the first portion 108 and the second portion 110 extend from each other or are otherwise coupled together, such as by a third portion 130. In some embodiments, the first and second portions 108, 110 may be formed together as a single element.

In some embodiments, the attachment member 100, which may be referred to as a shade or fabric lock in some embodiments, may be an elongate member including a length L extending a length of the rail member 106, a height H extending between the first and second portions 108, 110, and a transverse width W, which may be variable as described below. In some embodiments, the attachment member 100 may be sized for a particular application, such as coupling a rail member 106 of particular size to various-sized shade materials, including shade material 102, or vice-versa. As explained herein, the attachment member 100 positions at least a portion of the shade material 102 relative to the rail member 106 such as to affect or maintain the configuration, including, without limitation, the appearance, position, distance, and/or shape, of the shade material 102 located external to the rail member 106. In some embodiments, the attachment member 100 affects or maintains the configuration of the shade material 102 irrespective of the rail member 106 to which the shade material 102 is attached. For instance, the attachment member 100 may facilitate substantial uniformity of shape of the shade material 102 for different rail members 106, such as rail members 106 of various shapes, sizes, weights, balancing, biasing, or configurations, among others. For example, because the attachment member 100 influences the positioning of the shade material 102 external to the rail member 106, the properties of the rail member 106 may have no effect on the shade material 102 as the positioning of the shade material 102 is affected independently of the connection of the shade material 102 within the rail member 106.

In one non-limiting example, the first portion 108 is configured (e.g., sized and shaped) to couple, such as removably couple, the shade material 102 to the rail member 106. For instance, the first portion 108 and/or rail member 106 in the embodiment illustrated in FIGS. 2 and 3 is configured such that a difference in size of the first portion 108 in relation to a portion of the rail member 106 causes the first portion 108 to be locked, trapped, or otherwise captured within the rail member 106, though other means are contemplated including frictional and/or interference fit, among others. In the embodiment illustrated in FIGS. 2 and 3, the first portion 108 is enlarged such that the first portion 108 is held in place within the rail member 106 by a difference in dimension or shape in relation to an opening 144 of the rail member 106 via which the attachment member 100 may otherwise decouple from the rail member 106. For example, the first portion 108 is positioned at least partially within the rail member 106 (e.g., along its length L) to trap the first portion 108 and at least a portion of the shade material 102 within the rail member 106 to limit removal of the attachment member 100 and the shade material 102 from the rail member 106 during normal use of the covering 104. In such embodiments, the first portion 108 includes a first width $W_1$ that either alone or in combination with the material thickness of the shade material 102 wrapped about the first portion 108 may be sized greater than a corresponding dimension of the rail member 106, such as wider than the opening 144 of the rail member 106 (see FIG. 2), to secure the attachment member 100, and therefore the shade material 102, to the rail member 106, as explained more fully below. As illustrated, the shade material 102 and first portion 108 are positioned within the rail member 106, but a portion of the shade material 102 extends outwardly from within the rail member 106 to a position external to the rail member 106 and away from the rail member 106 to at least partially cover the architectural structure or opening which the architectural covering 104 is positioned to cover. The portion of the shade material 102 which extends outwardly from within the rail member in FIGS. 2-4 extends upwardly through the opening 144. If the first portion 108 (or the first portion 108 in combination with the material thickness of the shade material 102 extending through the opening 144) were not larger than the opening 144, then the first portion 108 would extend or pass through the opening 144 as well, causing the shade material 102 to be decoupled from the rail member 106. It will be appreciated that in the embodiments of FIGS. 2-4, the architectural covering 104 is a vertically extending covering and rail member 106 is at the bottom of the architectural covering 104 such that the rail member 106 may exert a downward force or bias on the shade material 102 which would cause the shade material 102 to decouple from the rail member 106 if the first portion 108 could pass through the opening 144. In one embodiment, the first portion 108 may be bulbous, such as circular in cross-section, though other shapes are contemplated including elliptical or polygonal, among others.

In one or more embodiments of the present disclosure, the second portion 110 is configured to position one or more portions of the shade material 102 in a desired relative position or spacing with respect to the rail member 106 outside or external to the rail member 106 to position the shade material 102 as desired. To provide the relative spacing of the one or more portions of the shade material 102, the second portion 110 may include a dimension varying (e.g., increasing) with distance away from the first portion 108 (see FIG. 2). For example, the second portion 110, which is positioned at least partially external to the rail member 106, may include a second width $W_2$ (see FIG. 2). The second width $W_2$ may be configured to position at least a portion of the shade material 102 (e.g., at least one of a front and rear portion of the shade material 102) relative to the rail member 106 external to the interior coupling of the shade material 102 and the rail member 106. In one embodiment, the second width $W_2$ may position opposing portions of the shade material 102 away from each other to provide a desired shape and/or spatial relationship of the various portions of the shade material 102, as explained below. Depending on the desired shape of the shade material 102 in relation to the various configurations of the rail member 106, the second width $W_2$ may be less than the first width $W_1$, greater than the first width $W_1$, or substantially equal to the first width $W_1$ of the first portion 108. If desired, the second portion 110 moves the portion of the shade material 102 from its natural position extending outwardly from its coupling position within the rail member 106, e.g., in the embodiments of FIGS. 2-4, to off-center from the opening 144, or otherwise offset from a position which would occur such as by the downward force of the rail member 106 on the shade material 102.

To provide a desired positioning of the shade material 102, for instance, the second portion 110 may include one or more legs, such as a first leg 120 and a second leg 122 extending away from the first leg 120, to define the varying width of the second portion 110 (see FIG. 2). As explained below, the one or more legs may position a portion of the shade material 102 external to the rail member 106. In the illustrated embodiments of FIGS. 2-4, the second portion 110 extends outside the rail member 106 to affect a portion of the shade material 102 outside the rail member 106. In one embodiment, at least a portion of the second portion 110, such as at least one of the legs (e.g., the second leg 122), may be arcuately shaped to provide, for instance, an arcuate shape to the shade material 102 at least adjacent the second portion 110 of the attachment member 100, as explained below. In some embodiments, the second portion 110, such as the first and second legs 120, 122, is arranged to provide symmetrical or asymmetrical shaping of the shade material 102. For instance, the second portion 110 may be asymmetrical about a vertical plane extending external to the rail member 106, such as along the height H of the attachment member 100 (see FIG. 2). In this manner, the attachment member 100 may position opposing portions of the shade material 102 different distances away from the vertical plane. For instance, as explained below, a front portion of the shade material 102 may be positioned further away in a horizontal direction from the point at which the shade material 102 is coupled to the rail member 106 with the first portion 108 as compared to a rear portion of the shade material 102. Though described as including first and second legs 120, 122, in some embodiments, the second portion 110 of the attachment member 100 may be defined by any number of legs, such as a single leg (e.g., the second leg 122) (see FIG. 4). As may be appreciated, the number of legs is not essential as one or more legs may be operable to position the shade material 102 external to the rail member 106 similar to the description that follows. Also, it will be appreciated that although the term "leg" is used, such term is not intended to limit the precise structure of the second portion 110, as other shapes or structures of the attachment member 100 may affect, such as by engaging, the shade material 102.

Depending on the size and shape of the rail member 106 and features thereof, the attachment member 100 may include a third portion 130 positioned (e.g., extending) between the first and second portions 108, 110. As explained further below, the third portion 130, which may be referred to as a connecting, separating, or spacing portion, element, or section or any combination thereof, may extend through a portion of the rail member 106, such as the opening 144, to couple the internal, first portion 108 and the external, second portion 110 of the attachment member 100 together. In such embodiments, the third portion 130 may define a portion of the height H of the attachment member 100, such as greater than about 33% of the height H, greater than about 50% of the height H, greater than each of the individual height contributions of the first and second portions 108, 110, greater than at least one of the individual height contributions of the first and second portions 108, 110, or the like. In some embodiments, the third portion 130 may be sized and shaped to match the functional demands on the attachment member 100. For example, the third portion 130 may be minimized for strength and/or material reduction to tailor the attachment member 100 to a particular application or environment.

In at least the embodiment of FIG. 2, the third portion 130 includes a third width $W_3$ configured to facilitate the various functions of the attachment member 100 described herein. For example, the third width $W_3$ may be less than the first width $W_1$, less than the second width $W_2$, or both. In some embodiments, the third portion 130 may be vertically aligned with a portion of the second portion 110 (e.g., the first leg 120) and/or a major plane of the shade material 102. For example, without limitation, the third portion 130 may extend substantially parallel to the major plane of the shade material 102. In some embodiments, the third portion 130 may be a reference point for defining the asymmetrical shaping of the attachment member 100. For example, the third portion 130 may define the vertical plane about which the attachment member 100 is asymmetrical.

In accordance with the present disclosure, the rail member 106 may have substantially any suitable shape or configuration to facilitate the various functions of the attachment member 100. In one embodiment, illustrated in FIGS. 1-3, the rail member 106 is an elongate member including one or more engagement features arranged to couple (e.g., releasably couple) the attachment member 100, and therefore the shade material 102, to the rail member 106. In some embodiments, the rail member 106 is configured to receive at least a portion of the attachment member 100. For example, the rail member 106 may include a hollow interior portion (e.g., a slot 138) in which a portion of the shade material 102 is positioned, and in which the shade material 102 is locked via the attachment member 100 (see FIG. 2). In a non-limiting embodiment, the slot 138 may be defined along a length of the rail member 106, such as by opposing tabs 140 extending along a length of the rail member 106. To limit removal of the attachment member 100 and therefore the shade material 102 from the rail member 106, as described above, the slot 138 includes a constricting opening 144, which may be defined in one non-limiting example by the opposing tabs 140 converging towards each other (see FIG. 2). In such embodiments, the shade material 102 extends through the opening 144 and is held or prevented from detaching from the rail member 106 via the attachment member 100, such as via the first portion 108 being larger (e.g., wider) than the opening 144. For example, to limit removal of the attachment member 100 through the opening 144, the first portion 108 of the attachment member 100 is enlarged such that its first width $W_1$ either alone or in combination with a material thickness of the shade material 102 wrapped about the first portion 108 is greater than the corresponding dimension of the opening 144 (see FIG. 2). In such embodiments, the attachment member 100 may be slid into the slot 138 transverse to the shade extension/retraction direction, as described more fully below. Once coupled to the rail member 106, the shade material 102 extends from within the rail member 106 to a position located external to the rail member 106 via the opening 144 and along the shade extension/retraction direction.

To provide a desired aesthetic and/or functional characteristic, the shape of the rail member 106, such as defined by the tabs 140, may provide a smooth transition between the rail member 106 and the shade material 102. For example, the tabs 140 may be shaped (e.g., rounded) to allow the shade material 102 to extend from within the rail member 106 to a position located external to the rail member 106 without harming the shade material 102 (e.g., tearing, creasing, snagging, etc.) and/or without binding or puckering the shade material 102 adjacent the rail member 106. Depending on the particular application, the slot 138 and/or the tabs 140 may extend along a portion of the length of the rail member 106, along the entire length of the rail member 106, or intermittently along the length of the rail member 106. In some embodiments, the slot 138 and/or the tabs 140 may extend the entire width of the shade material 102.

As explained more fully below, at least a portion of the attachment member 100 extends through the slot 138 in coupling the shade material 102 to the rail member 106. For instance, the attachment member 100 may extend through the slot 138 such that the first and second portions 108, 110 of the attachment member 100 extend respectively within and external to the rail member 106 (see FIG. 2) and are coupled to each other by the third portion 130 extending through the opening 144. In such embodiments, the attachment member 100 couples or locks the shade material 102 with the rail member 106 such that the elements do not decouple in the shade extension/retraction direction. Such a connection may be achieved by the enlarged, first portion 108 of the attachment member 100. As may be appreciated, a simple manner of initially coupling these elements is to couple the shade material 102 (e.g., a bottom end of the shade material 102) to the attachment member 100 and insert the coupled attachment member 100 and shade material 102 into an axial end 146 of the rail member 106 (see FIG. 3). For example, the slot 138 may be open at the axial end 146 of the rail member 106 to permit the attachment member 100 and at least a portion of the shade material 102, which may be coupled to, wrapped around, engaged with or generally associated with (generally referred to herein as "coupled" without the intent to limit), the attachment member 100 to be slid laterally within the slot 138 from the axial end 146 of the rail member 106 with the first portion 108 of the attachment member 100 positioned within the rail member 106 (e.g., within the slot 138) and the second portion 110 of the attachment member 100 positioned external to the rail member 106 (e.g., above the opening 144) (see FIG. 3). Once the attachment member 100 is positioned within the slot 138 of the rail member 106, the third portion 130 of the attachment member 100 extends through the opening 144 of the slot 138 to allow the first and second portions 108, 110 to be positioned as noted above. In this manner, the shade material 102 is coupled to the rail member 106 and a portion of the shade material 102 is positioned (e.g., shaped) external to the rail member 106, as explained below. In some embodiments, an end cap 148 may close each axial end 146 of the rail member 106 (e.g., at least the axial ends of the slot 138) to limit lateral shifting/removal of the attachment member 100 and the shade material 102 from the slot 138 (see FIG. 1). Though the rail member 106 is shown as a bottom rail, it is contemplated that the rail member 106 may be any rail-type member of the architectural covering 104, such as a top rail, a middle rail, or a head rail, among others, coupled to the shade material 102.

The shade material 102 and its interaction with the attachment member 100 and the rail member 106 will now be discussed in more detail. In accordance with various embodiments of the present disclosure, the shade material 102, which may be referred to as a blanket, fabric sheet, shade, or the like, may be substantially any type of shade element, such as a horizontal or vertical shade element movable to extend at least partially across an architectural opening. For example, the shade material 102 may take on substantially any shape or configuration, such as being similar to the shades disclosed in U.S. Pat. No. 6,345,486B1, U.S. Publication No. 2014/0034251 A1, and/or U.S. Publication No. 2014/0053989 A1, the disclosures of which are hereby incorporated by reference in their entirety. In one embodiment, the shade material 102 may include one or more cells 160, which may be operational and may be open or closed-type cells, providing a desired aesthetic and/or functional characteristic (e.g., design appeal, insulation capacity, light blocking/dispersing functionality, etc.) (see FIG. 1). The cells 160 may be arranged horizontally or vertically in a cellular panel configuration or blanket. For example, the cells 160 may be stacked one on top of the other to define a continuous cellular panel (see FIG. 1), may be spaced apart from one another to define a discontinuous cellular panel, or may be arranged in any other configuration within the scope of the present disclosure. In one non-limiting example, each cell 160 may be defined by a wall 162 and a front vane 164 extending (e.g., away from) from the wall 162 (see FIG. 2). The wall and the front vane 162, 164 of each cell 160 may be separate sheets of material or may be formed from a single sheet of material. In some embodiments, the wall 162 of two or more adjacent cells 160 may be formed from a continuous sheet of material, or may be separate strips of material attached together, or may be formed from an extension of a front vane 164 forming an adjacent cell. The front vane 164 of two or more adjacent cells 160 generally is formed from a sheet of material configured to impart a cellular shape, or may be otherwise configured, such as in a manner similar to the configuration of wall 162.

According to the present disclosure, the attachment member 100 engages and positions at least one of a front portion and a rear portion of the shade material 102 relative to the rail member 106. In one embodiment, the attachment member 100 may engage and position the front vane and the wall 164, 162 of at least one cell 160, such as a lowermost cell 166 or an uppermost cell, of the shade material 102. For example, as described below, a portion of the attachment member 100 (e.g., the first leg 120 of the second portion 110) may interact with and affect (e.g., shape) a rear portion of the shade material 102, such as the wall 162 of the lowermost cell 166. Similarly, another portion of the attachment member 100 (e.g., the second leg 122 of the second portion 110) may interact with and affect (e.g., shape) a front portion of the shade material 102, such as the front vane 164 of the lowermost cell 166. Though the attachment member 100 may be utilized in relation to any portion of the shade material 102, for ease of reference, the following description is presented in relation to a lowermost cell 166. The concepts discussed below may be applied equally to other portions of the shade material 102 (e.g., to an uppermost cell). In addition, as will be appreciated by one of ordinary skill in the art, the concepts discussed herein may be applied equally to other shade types having a front portion and a rear portion.

In the specific embodiment of FIG. 2, the attachment member 100 may be positioned at least partially within a portion (e.g., a cellular section) of the shade material 102, such as that formed by the lowermost cell 166, in securing the shade material 102 to the rail member 106. For example, the attachment member 100 may be positioned within the bottom of the shade material 102, such as adjacent the lower region of the lowermost cell 166 at which the front vane 164 separates from the wall 162. The bottom of the lowermost cell 166 may be positioned within the slot 138 of the rail member 106, such as by extending the bottom of the lowermost cell 166 through the opening 144 and into the slot 138. To couple the shade material 102 to the rail member 106, the bottom of the lowermost cell 166 may wrap around the attachment member 100 positioned within the slot 138, such as around the first portion 108 (see FIG. 2). To limit disassembly in the shade extension/retraction direction, the dimension of the first width $W_1$ of the attachment member 100 in combination with the material thicknesses of the front vane and the wall 164, 162 of the lowermost cell 166 may provide the necessary dimensional difference relative the opening 144 to limit removal of the attachment member 100 and the shade material 102 through the opening 144. In one example, the opening 144 may be sized to permit the third portion 130 of the attachment member 100 and the front vane and the wall 164, 162 of the lowermost cell 166 to extend therethrough (see FIGS. 2-4). If desired, the third portion 130 and the shade material 102 may fit snugly within the opening 144 to limit rotational movement (e.g., twisting) of the attachment member 100 relative to the rail member 106. This may be desirable in embodiments wherein the second portion 110 does not include the first leg 120 (see FIG. 4).

Once the shade material 102 is coupled to the rail member 106, the second portion 110 of the attachment member 100 is operable to affect or maintain the configuration, including without limitation the appearance, position, distance, and/or shape, of the shade material 102 external to the rail member 106. For example, according to various aspects of the present disclosure, the configuration of the attachment member 100, and in particular the shape of the second portion 110, is operable to maintain a desired characteristic of the shade material 102 external to the rail member 106, such as a desired shape of at least a front portion of the shade material 102 located external to the rail member 106. In one embodiment, the attachment member 100 (e.g., the second portion 110) may be configured to maintain a cellular characteristic of a cellular shade material 102 located external to the rail member 106, such as by positioning the front vane 164 of the lowermost cell 166 away from its opposing wall 162. Because of the constricting nature of the opening 144, the cellular shape of the lowermost cell 166 may be biased to close without the directional influences of the second portion 110, which may cause the lowermost cell 166 to take on a different cellular shape than one or more adjacent cells 160. To overcome any natural tendency of the front vane and the wall 164, 162 to flatten against each other, such as under the weighting bias provided by the rail member 106, for instance, the second portion 110 of the attachment member 100 may separate the front vane away from the wall 164, 162 at a position adjacent (e.g., above) the opening 144 of the rail member 106 to maintain an open cellular configuration of the shade material 102, for example. For instance, the shape of the second portion 110 may cause the lowermost cell 166 to include a profile shape consistent, similar, or identical to adjacent cells 160. For instance, the diverging nature of the second portion 110 may direct the front vane 164 of an associated cell 160 away from the wall 162 at a desired angle, shape, distance, or the like, such as the first and second legs 120, 122 of the attachment member 100 causing the front vane 164 to be spaced away from the wall 162.

Figure 4:
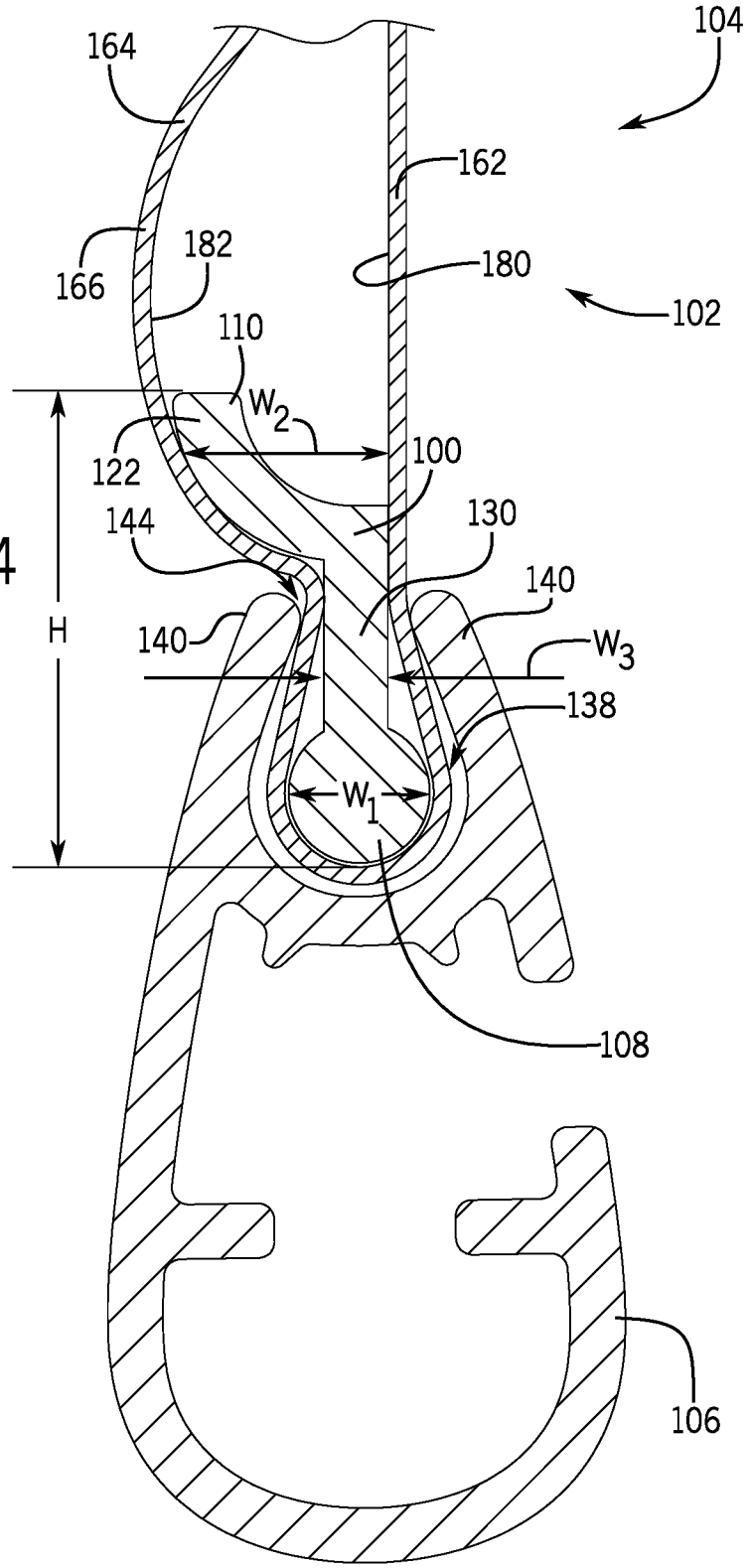
FIG. 4 is a fragmentary cross-sectional view of an additional attachment member in accordance with an embodiment of the present disclosure.

Referring to FIG. 4, in one embodiment, the second portion 110 the attachment member 100 may include a single leg, referred to herein as the second leg 122. In this embodiment, the second leg 122 of the attachment member 100 may engage an inner surface 182 of the front vane 164. In such embodiment, the second leg 122 of the second portion 110 may space the inner surface 182 of the front vane 164 away from the wall 162 to achieve a desired shape of the shade material 102 adjacent the rail member 106, such as causing the shape of the lowermost cell 166 to correspond to the shape(s) of other cells 160. For example, the shape of the second leg 122 may respectively guide the front vane 164 of the lowermost cell 166 as desired, such as causing the front vane 164 of the lowermost cell 166 to extend arcuately similar to adjacent cells 160 (see FIG. 2). To impart an arcuate shape to the front vane 164, the second leg 122 may be arcuately-shaped itself, such as including a convexly-shaped outer surface 184 engageable with the inner surface 182 of the front vane 164 (see FIG. 3).

Referring to FIG. 2, in one embodiment, the second portion 110 the attachment member 100 may include first and second legs 120, 122. The first leg 120 may engage an inner surface 180 of the wall 162, and the second leg 122 may engage an inner surface 182 of the front vane 164 (see FIG. 2). In such embodiments, the first and second legs 120, 122 of the second portion 110 may space the inner surfaces 182, 180 of the front vane and the wall 164, 162 away from each other to achieve a desired shape of the shade material 102 adjacent the rail member 106, such as causing the shape of the lowermost cell 166 to correspond to the shape(s) of other cells 160. For example, the shape of the first and second legs 120, 122 may respectively guide the wall and the front vane 162, 164 of the lowermost cell 166 as desired, such as causing the wall 162 of the lowermost cell 166 to extend substantially vertical and causing the front vane 164 of the lowermost cell 166 to extend arcuately similar to adjacent cells 160 (see FIG. 2). In one embodiment, the first leg 120 may be aligned with the wall 162 of the shade material 102 so that the wall 162 hangs vertically without any twisting. For example, the first leg 120 may be aligned with the wall 162 to maintain the bottom of the shade material 102 in a desired alignment, such as vertically aligned with the rail member 106, such as relative to the opening 144. In some embodiments, the first leg 120 counterbalances the force the second leg 122 exerts on the shade material 102 to position the shade material 102 relative to the rail member 106, such as to prevent the portion of the shade material 102 affected by the second portion 110 from moving, such as curving, (e.g., rearwardly) towards the architectural structure or opening which the architectural covering 104 is positioned to cover. To impart an arcuate shape to the front vane 164, the second leg 122 may be arcuately-shaped itself, such as including a convexly-shaped outer surface 184 engageable with the inner surface 182 of the front vane 164 (see FIG. 3).

The covering 104 and its components may be constructed of substantially any type of material. For example, the attachment member 100 and the rail member 106 may be constructed or formed from natural and/or synthetic materials, including metals, ceramics, plastics, and/or other suitable materials. Plastic materials may include thermoplastic material (self-reinforced or fiber-reinforced), ABS, polycarbonate, polypropylene, polystyrene, PVC, polyamide, or PTFE, among others. The attachment member 100 and the rail member 106 may be built, formed, or molded, in any suitable manner, such as by plug molding, blow molding, injection molding, milling, extrusion, casting, or the like.

Because at least a portion of the attachment member 100 (e.g., the second portion 110 of the attachment member 100) is positioned within the cross-sectional area of the lowermost cell 166 of the shade material above the rail member 106, the attachment member 100 (or at least the second portion 110) may be substantially clear to permit light transmission therethrough. In some embodiments, the light transmission through the attachment member 100 may be such so as to limit shadowing of the attachment member 100 through the shade material 102, which may be desirable to substantially conceal the attachment member 100 from view.

The shade material 102 may be constructed or formed from natural and/or synthetic material presented in a woven or non-woven fabric. In some embodiments, the material and/or configuration of the shade material 102 may facilitate opening of the one or more cells 160 of the shade material 102. For example, the material and/or configuration of the shade material 102 may cause the front vane 164 of each cell 160 to be biased or pop open away from its opposing wall 162. In such embodiments, the attachment member 100, and in particular the second portion 110 of the attachment member 100, may facilitate sufficient popping and/or opening of the lowermost cell 166, thus facilitating a more uniform profile appearance of the shade material 102, as explained above.

According to an aspect of the present disclosure, the attachment member couples the shade material of the architectural covering to the rail member. The attachment member includes the first portion arranged to couple the shade material within a slot formed in the rail member, and the second portion arranged to engage a portion of the shade material located external to the rail member.

In some embodiments, the first portion is arranged to couple the shade material to the interior of the rail member.

In some embodiments, the second portion includes a width dimension varying with distance away from the first portion. In some embodiments, the width dimension increases with distance away from the first portion.

In some embodiment, the second portion of the attachment member includes a front portion arranged to position a front vane of the shade material away from a wall of the shade material to shape at least a portion of the shade material.

In some embodiment, the second portion is coupled to or extends from the first portion. In some embodiment, the first and second portions are formed together as a single element.

In some embodiments, the architectural covering includes a shade material, a rail member, and an attachment member coupling the shade material to the rail member. The attachment member including a first portion extending at least partially within the rail member and a second portion extending at least partially externally away from the rail member to affect the shade material located external to the rail member.

In some embodiments, the first portion couples the shade material within the rail member, and the second portion is configured to maintain a configuration of the shade material adjacent to the rail member. In some embodiment, the shade material includes a plurality of cells, the attachment member may at least partially extend within a lowermost cell of the plurality of cells forming the shade material. The attachment member being configured to maintain a configuration of a front portion of the lowermost cell such that the appearance of the front portion is consistent with other cells of the shade material.

In some embodiment, the attachment member extends along a portion of the shade material located external to the rail member, the attachment member configured to maintain a configuration of a portion of the shade material immediately adjacent the rail member such that the appearance of the portion of the shade material is consistent with other portions of the shade material. In some embodiment, the shade material includes a plurality of cells, the attachment member extends within a lowermost cell of the plurality of cells of said the material; and the attachment member maintains a configuration of the lowermost cell such that the appearance of the lowermost cell is consistent with other cells of the plurality of cells of the shade material.

In some embodiments, the first portion may couple the shade material to the rail member, the second portion may be arranged to maintain the configuration of the lowermost cell of the shade material. The second portion may include a first leg and a second leg extending away from the first leg. The second leg may be arcuately-shaped. The second leg may extend towards the front portion of the shade material. The second portion may be asymmetrical about a vertical plane.

In some embodiments, the second portion of the attachment member includes a front portion arranged to position a front vane of the shade material away from a wall of the shade material to shape at least a portion of the shade material.

In some embodiments, the shade material includes at least one cell, each cell defined by a wall and a front vane extending away from the wall, the second portion is configured to position at least one of the front vane and the wall external to the rail member.

In some embodiment, the rail member includes a slot; and the shade material is coupled within the rail member and extends through the slot. The slot may define an opening and the first portion of the attachment member is enlarged to limit removal of the attachment member and the shade material through the opening. A portion of the attachment member may extend through the opening.

In some embodiment, the rail member is a bottom rail.

In some embodiments, the second portion of the attachment member is coupled to or extends from the first portion. The first and second portions may be formed together as a single element.

In some embodiment, the portion of the shade material engaged by the second portion extends away from the rail member. The portion of the shade material engaged by the second portion at least partially covers an associated architectural opening when the shade material is in an extended configuration.

According to another aspect of the present disclosure, a method of assembling the architectural covering 104 includes associating the attachment member with the shade material, coupling a portion of the shade material to the rail member via the attachment member, and affecting a portion of the shade material external to the rail member via the attachment member.

In some embodiments, affecting the shape of the portion of the shade material external to the rail member includes positioning a first portion of the shade material relative to the rail member. In some embodiments, affecting the shape of the portion of the shade material external to the rail member includes positioning the front portion away from an opposing second portion of the shade material.

In some embodiments, associating the attachment member with the shade material includes positioning the attachment member at least partially within a cell of the shade material, and affecting the shape of the portion of the shade material includes affecting the shape of the cell adjacent to the rail member via the attachment member.

In some embodiments, the method further includes extending the attachment member from within the rail member to a location external to the rail member. In some embodiments, coupling the portion of the shade material to the rail member includes coupling the shade material to the interior portion of the rail member. In some embodiments, affecting the shape of the portion of the shade material includes affecting the shape of the portion of the shade material located external to the rail member.

The foregoing description has broad applicability. It should be appreciated that the concepts disclosed herein may apply to different types of shades having different configurations. It should be appreciated that the concepts disclosed herein may apply to many types of shades, including roller and non-roller shades. Similarly, it should be appreciated that the concepts disclosed herein may apply to many types of attachment members, in addition to the attachment member 100 described and depicted herein. For example, the concepts may apply equally to any type of covering 104 having a shade material 102 movable across an architectural structure. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

What is claimed is:

1. An architectural covering, comprising:

a shade material including a rear portion and a front portion;

a rail member including an elongated slot, said slot including an opening formed in a top end of said rail member; and an attachment member coupling said shade material to said rail member, said attachment member including a first portion extending at least partially within said elongated slot of said rail member for pressing said shade material against said rail member within said elongated slot of said rail member, and a second portion extending through said opening and at least partially externally away from said rail member;

wherein said second portion of said attachment member includes a first leg and a second leg, said first and second legs positioned at least partially into said shade material, said first leg contacting a front surface of said rear portion of said shade material, said second leg contacting a rear surface of said front portion of said shade material configured to bias said front portion of said shade material away from said rear portion of said shade material located external to said rail member.

2. The architectural covering of claim 1, wherein:

said second portion is configured to maintain a configuration of said shade material adjacent to said rail member.

3. The architectural covering of claim 1, wherein said shade material includes a plurality of cells, said attachment member at least partially extends within a lowermost cell of said plurality of cells forming said shade material, said attachment member being configured to maintain a configuration of said front portion of said lowermost cell.

4. The architectural covering of claim 1, wherein said attachment member extends along a portion of said shade material located external to said rail member, said attachment member configured to maintain a configuration of a portion of said shade material immediately adjacent said rail member.

5. The architectural covering of claim 4, wherein:

said shade material includes a plurality of cells;

said attachment member extends within a lowermost cell of said plurality of cells of said shade material; and said attachment member maintains a configuration of said lowermost cell.

6. The architectural covering of claim 5, wherein said first portion couples said shade material to said rail member, said second portion is arranged to maintain said configuration of said lowermost cell of said shade material.

7. The architectural covering of claim 6, wherein said second leg extends away from said first leg.

8. The architectural covering of claim 7, wherein said second leg is arcuately-shaped.

9. The architectural covering of claim 7, wherein said second portion is asymmetrical about a vertical plane.

10. The architectural covering of claim 1, wherein said second leg of said second portion of said attachment member is arranged to position said front portion of said shade material away from said rear portion of said shade material to shape at least a portion of said shade material.

11. The architectural covering of claim 1, wherein:

said first portion of said attachment member is enlarged to limit removal of said attachment member and said shade material through said opening.

12. The architectural covering of claim 1, wherein said first and second portions are formed together as a single element.

13. An attachment member for coupling a shade material of an architectural covering to a rail member including an elongated slot having an opening formed in a top end of the rail member, said attachment member comprising:

a first portion arranged and configured to press the shade material against an inner surface of the slot formed in the rail member; and a second portion arranged and configured to extend through the opening in the rail member and to engage a portion of the shade material located external to the rail member;

wherein said second portion comprises a first leg and a second leg arranged and configured to extend into the shade material, said first leg contacting a front surface of a rear wall of the shade material, said second leg contacting a rear surface of front portion of the shade material configured to bias the front portion away from the rear wall.

14. The attachment member of claim 13, wherein said second portion includes a width dimension varying with distance away from said first portion.

* * * * *